US005436524A

United States Patent [19]

Hagen et al.

[11] Patent Number: 5,436,524

[45] Date of Patent: Jul. 25, 1995

[54] ORTHOGONALLY INTERDIGITATED SHIELDED SERPENTINE TRAVELLING WAVE CATHODE RAY TUBE DEFLECTION STRUCTURE

[75] Inventors: Edward C. Hagen, Las Vegas, Nev.; Charles L. Hudson, Santa Barbara, Calif.

[73] Assignee: The United States of America as represented by the Department of Energy, Washington, D.C.

[21] Appl. No.: 141,751

[22] Filed: Oct. 27, 1993

Related U.S. Application Data

[63] Continuation-in-part of Ser. No. 968,630, Oct. 29, 1992, Pat. No. 5,376,864.

[51] Int. Cl.[6] ..... H01J 23/10

[52] U.S. Cl. ..... 315/3; 315/5.24; 313/421

[58] Field of Search ..... 315/3, 5.24, 5.25, 5.26, 315/7, 8; 313/421, 431

[56] References Cited

U.S. PATENT DOCUMENTS

| | | | |
|---|---|---|---|
| 2,080,449 | 5/1937 | Von Ardenne | 250/27 |
| 2,139,829 | 12/1938 | Knoll | 250/162 |
| 2,206,668 | 7/1940 | Hollmann | 315/7 X |
| 2,233,126 | 2/1941 | Haeff | 315/5.26 X |
| 2,332,881 | 10/1943 | Woerner | 313/736 X |
| 2,681,426 | 6/1954 | Schlesinger | 315/24 |
| 2,807,740 | 9/1957 | Hallden | 315/8 |
| 3,118,110 | 1/1964 | Spangenberg | 315/7 X |
| 3,219,873 | 11/1965 | Kaufman | 315/5.24 X |
| 3,504,222 | 3/1970 | Fukushima | 315/3 |
| 3,644,777 | 2/1972 | Thomas et al. | 315/3 |
| 4,093,891 | 6/1978 | Christie et al. | 315/3 |
| 4,556,823 | 12/1985 | Keller et al. | 315/111 |
| 4,695,775 | 9/1987 | Ritzman et al. | 315/410 |
| 4,812,707 | 3/1989 | Correll et al. | 313/435 |
| 5,172,029 | 12/1992 | Norris et al. | 315/3 |

*Primary Examiner*—Benny T. Lee

*Attorney, Agent, or Firm*—Miguel A. Valdes; Roger S. Gaither; William R. Moser

[57] ABSTRACT

A new deflection structure (12) which deflects a beam of charged particles, such as an electron beam (15), includes a serpentine set (20) for transmitting a deflection field, and a shielding frame (25) for housing the serpentine set (20). The serpentine set (20) includes a vertical serpentine deflection element (22) and a horizontal serpentine deflection element (24). These deflection elements (22, 24) are identical, and are interdigitatedly and orthogonally disposed relative to each other, for forming a central transmission passage (75), through which the electron beam (15) passes, and is deflected by the deflection field, so as to minimize drift space signal distortion. The shielding frame (25) includes a plurality of ground blocks (26, 28, 30, 32), and forms an internal serpentine trough (77) within these ground blocks, for housing the serpentine set (20). The deflection structure (12) further includes a plurality of feedthrough connectors (35, 37, 35I, 37I), which are inserted through the shielding frame (25), and which are electrically connected to the serpentine set (20).

19 Claims, 8 Drawing Sheets

ORTHOGONALLY INTERDIGITATED SHIELDED SERPENTINE TRAVELLING WAVE CATHODE RAY TUBE DEFLECTION STRUCTURE

STATEMENT OF GOVERNMENTAL RIGHTS

The United States Government has rights in this invention pursuant to Contract No. DE-AC08-88NV10617 between the United States Department of Energy and EG&G Energy Measurements.

CROSS-REFERENCE TO RELATED APPLICATIONS

This is a continuation-in-part application of the U.S. patent application Ser. No. 07/968,630, filed on Oct. 29, 1992, now U.S. Pat. No. 5,376,864, issued 27 Dec. 1994 entitled "Shielded Serpentine Traveling Wave Tube Deflection Structure", which is incorporated herein by reference.

BACKGROUND OF THE INVENTION

The present invention generally relates to high bandwidth cathode ray tubes (CRT's), and more particularly to an improved shielded travelling wave cathode ray tube deflection structure.

Travelling wave devices used to deflect electron beams in cathode ray tubes are well known in the art. In conventional cathode ray tubes, it takes an electron beam a finite amount of time to travel from a source electrode or electron gun, to its destination such as a phosphor screen.

The problem associated with conventional electron beam deflection devices, usually including parallel plates, is that the beam cannot be accurately deflected to reflect variations in a very high frequency modulating source, the modulations of which occur during the electron transit time through the deflection structure. An attempted solution to this problem has been to cause wave deflection forces to "travel" a finite distance along with the electrons during their traverse between the source electrode and the destination.

For this purpose, conventional travelling wave very high frequency cathode ray tubes include a slow wave electron beam deflection device, which is necessary to time the deflection signals, such that the sequential appearance of discrete infinitesimal intervals of the travelling deflecting field at the electron beam matches the speed of the electrons to be deflected. The slow wave deflection device generally takes the form of a structure which causes the signal to meander along a circuitous path.

Deflection structures could take the form of serpentine or helical coil structures. Several different types and modifications of such structures have been described in the patent literature. For example, Tomison et al. U.S. Pat. No. 4,207,492 describes an electron beam deflection structure comprising serpentine deflection plate segments which are interconnected together by elongated loops.

Norris et al., U.S. Pat. No. 5,172,029 discloses various embodiments of a helical coil deflection structure of a CRT, for providing shielding between adjacent turns of the coil on either three of four sides of each turn of the coil. Threaded members formed with either male or female threads and having the same pitch as the deflection coils are utilized for shielding the deflection coil with each turn of the helical coil placed between adjacent threads, which act to shield each coil turn from adjacent turns and to confine the field generated by the coil to prevent or inhibit cross-coupling between adjacent turns of the coil to thereby prevent generation of fast fields which might otherwise deflect the beam out of time synchronization with the electron beam modulation.

Correll U.S. Pat. No. 4,812,707 discloses an electron beam deflection structure of the travelling wave type, comprising a first helical coil and second helical coil that are interleaved with one another, and coaxial with the axis of the tube. The first coil has wide segments positioned on the bottom with narrow segments on the top, while the second coil has wide segments on the bottom and narrow segments on the top. Differential voltage signals of opposite polarity are applied to the first and second coils.

Nishino et al. U.S. Pat. No. 3,696,266 shows an electrode beam deflecting device with a helical electrode coaxially surrounded by a cylindrical outer electrode. By tapering the helical structure forwardly on its side defining the passage of the electron beam, the center line of the beam is deviated for an angle one-half that of the taper.

Odenthal et al. U.S. Pat. No. 3,694,689 and Reissue U.S. Pat. No. 28,223 describe a helical delay line deflection apparatus to reduce the deflection signal in the axial direction along the helical deflector until it is equal to the electron beam velocity, in order to permit very high frequency signals to deflect the beam without appreciable distortion.

Crandall U.S. Pat. No. 3,916,255 shows a phase array amplifier for generating multiple channels of high frequency electromotive power. Each channel contains an electron beam gun to generate an electron beam, and deflection plates along the beam path to modulate the beam. In one embodiment, the deflector plates comprise a helical electrode and control grounded electrode.

Loty et al. U.S. Pat. No. 3,376,464 discloses a cathode ray apparatus which includes a flat helical deflection electrode and a second electrode having a part within the helical electrode disposed along its axis and an outer part substantially surrounding the helical electrode.

Christie et al. U.S. Pat. No. 4,093,891 describes an electron beam deflection apparatus which comprises a pair of diverging flat helically wound coils that are disposed on opposite sides of the beam axis.

Piazza et al. U.S. Pat. No. 3,849,695 shows a deflection structure for a cathode ray tube which comprises a helical electrode bonded to the teeth of a comb-like dielectric support structure. The electron beam passes between the helical electrode and a ground plane. In one embodiment, two such helical electrodes oppose one another and two opposing ground plane electrodes are situated adjacent to the helical electrodes with the beam passing down the middle between the opposing helical electrodes and ground plane electrodes.

Chang U.S. Pat. No. 4,429,254 discloses an electron beam deflection yoke comprising four rod-shaped members running parallel to the axis of the beam and disposed around the beam axis, each having a wire coil that is wound along the rod to form horizontal and vertical deflection coils.

However, in the operation of many of the conventional traveling wave cathode ray tubes, a problem of particular concern exists, which causes a "precursor" artifact to appear on the CRT trace, in advance of a pulse rise time, when a fast pulse is recorded by the CRT. This spurious signal is caused by fields which are not confined to the helical or serpentine deflection element or deflection coils, or are transmitted by higher velocity modes in the space between the helix or serpentine and the ground planes.

These fast fields deflect the electron beam at an earlier time than the correct time in the pulse and cause an erroneous signal to appear where there should be none. This artifact or spurious signal is more serious and detrimental in high bandwidth cathode ray tubes, i.e. having a bandwidth of 2 GHz or above, because the high frequency components of these signals are preferentially coupled along the structure of the slow wave device.

It is known that precursor signals can be eliminated by means of specialized helical structure or by interposing grounded metal fins between the adjacent bars of serpentine slow wave structures. However, the simple imposition of grounded metal fins does not prevent the appearance of resonances caused by characteristic impedance discontinuities at the "loops" of the serpentine, nor does it provide a discontinuity-free deflection element necessary for propagation of high fidelity and high bandwidth signals.

Most of the following exemplary patents constitute improvements to the cathode ray tube in which an electron beam is created, accelerated along the z-direction, and focussed and deflected along the x and y directions.

Von Ardeen U.S. Pat. No. 2,080,449 describes a cathode ray tube having mutually engageable wedge-shaped teeth 14' and 15' that are disposed on a cylindrical electrode system, in order to prevent beam deviation. The cathode ray tube uses two pairs of deflecting plates that are arranged in series, and perpendicularly with respect to each other.

Knoll U.S. Pat. No. 2,139,829 describes a cathode ray tube which includes a separate pair of deflection structures. These structures are disposed in series and are of the low-bandwidth type.

Woerner U.S. Pat. No. 2,332,881 discloses a cathode ray tube arrangement that includes predeflecting condenser plates 1 and 2 and pole pieces 6 and 7. This arrangement is an application of cross field spectrometers. The stated object of the invention is to prevent negative ions that are heavier than electrons from striking the target. The deflection structure includes a pair of deflection plates 4 and 5, and a magnetic coil deflector. The predeflecting plates 1 and 2, are corrected by the magnetic field, and are physically separated from the deflection plates 4 and 5.

Schlesinger U.S. Pat. No. 2,681,426 relates to an electro-static deflection system for use in a cathode ray tube. The deflection system includes an electrode arrangement having a hollow space. The electrode arrangement includes deflection electrodes that are interleaved.

Keller U.S. Pat. No. 4,556,823 describes a multi-function charged particle apparatus capable of simultaneous focusing, positioning and scanning of an ion beam. The apparatus uses metallic elements to forms the sides of an open-ended substantially box-shaped structure. Application of AC and DC fields within the structure that deflects an ion beam, so as to perform the functions of positioning, focusing and scanning.

Ritzman U.S. Pat. No. 4,695,775 relates to an imaging system for focusing and deflecting an electron beam. The imaging system includes a solenoid for generating a substantially uniform magnetic field within the envelope and along the longitudinal axis thereof. It further includes an electrostatic yoke for generating a variable substantially uniform electric field within the envelope. The yoke includes a pair of overlaid conductive layers, which include two pairs of interleaved electrodes for deflecting the electron beam.

Correll U.S. Pat. No. 4,812,707 discloses a traveling wave push-pull electron beam deflection structure 10 having voltage gradient compensation. The deflection structure 10 includes a first helical coil member 48 and a second helical coil member 50, that are coaxial with a longitudinal axis 26 of the cathode ray tube. The helical coil members are interleaved, and cause the electrons to be deflected, first in the x direction, and then in the y direction.

The applications for cathode ray tubes are numerous, and range from electron microscopes, to television display tubes and electronic diagnostic instrumentation. In the latter application, the cathode ray tube uses the signal to be measured to deflect the electron beam in the x direction, and a constantly increasing signal to deflect the electron beam in the y direction. The target destination could be a phosphor screen or a solid-state readout device. The result is that the cathode ray tube draws an analogue graph depicting signal amplitude versus time.

Among the most important features of this type of cathode ray tubes, are: low distortion for allowing an accurate measurement of the signal; and high bandwidth for allowing high frequencies (i.e. multigigahertz) and fast signals (i.e. several picoseconds) to be measured.

As described above, the fast signals or fields could be significantly eliminated in accordance with the teachings of the Norris et al. U.S. Pat. No. 5,172,029. Fast signals have also been significantly eliminated in some serpentine structures, by interposing grounded metal fins between the adjacent bars of the serpentine turns.

Many deflection structures are arranged in a balanced configuration, where oppositely disposed structures are mounted in exact registration with each other. Consequently, an evenly distributed signal field is created between the deflection structures, resulting in the minimization of structure generated velocity modulation and transverse deflection distortions.

However, another type of velocity modulation distortion is also caused by the drift spaces between the deflection structures or elements. This distortion results in the "defocussing" at the cathode ray tube screen. The defocussing severity depends on the modulation frequency, the length of the drift space, and the electron beam velocity. For a fixed electron beam velocity and modulation frequency, it has been experimentally confirmed that the amount of defocussing distortion is a function of the length of the drift space between the deflection structures.

It would therefore be desirable to provide a deflection structure for a cathode ray tube device or oscilloscope, which would eliminate the defocussing effect resulting from the drift space distortion, and the propagation of fast signals along the deflection structures.

SUMMARY OF THE INVENTION

It is therefore an object of the present invention to provide a deflection structure for a cathode ray tube device or oscilloscope, which significantly reduces, if not completely eliminates, the defocussing effect resulting from the drift space distortion.

It is another object of the present invention to provide a deflection structure which significantly reduces, if not completely eliminates, the propagation of fast signals along the deflection structures.

It is yet another object of the present invention to reduce the number of discrete and separate deflection structures in order to reduce the overall length of the cathode ray tube.

Briefly, the foregoing and other objects are realized by a new deflection structure for use in a cathode ray tube. The deflection structure deflects a beam of charged particles, such as an electron beam. It includes a serpentine set, and a shielding frame for housing the serpentine set. The serpentine set and the shielding frame together form a coaxial deflection element of a specific characteristic impedance for transmitting a deflection field.

The serpentine set includes a vertical serpentine deflection element and a horizontal serpentine deflection element. These deflection elements are identical, and are interdigitatedly and orthogonally disposed relative to each other, for forming a central transmission passage through which the electron beam passes and is deflected by the deflection field, so as to minimize drift space signal distortion.

The shielding frame includes a plurality of ground blocks, and forms an internal serpentine trough within these ground blocks for housing the serpentine set. The deflection structure further includes a plurality of feedthrough connectors that are inserted through the shielding frame, and that are electrically connected to the serpentine set.

The cathode ray tube of the present invention could be used in several applications, such as high bandwidth oscilloscopes that are designed for minimal distortion single transient waveform recording, and other devices that are designed to provide minimal distortion high frequency deflection of an electron beam.

The serpentine deflection structure is intended to replace conventional slow wave deflection structures in high bandwidth oscilloscopes and other devices, where it is desired to provide a high frequency deflection of the electron beam. The serpentine deflection structure of the present invention may be substituted in such devices for conventional slow wave deflection structures.

Therefore, the deflection structure of the present invention results in near zero drift space signal distortion in the cathode ray tube, by virtue of its interdigitated horizontal and vertical serpentine elements.

Additionally, the vertical and horizontal deflection occurs nearly simultaneously due to the collocation of the vertical and horizontal deflection structures, which are electrostatic.

The horizontal and vertical interchangeability of the deflection structures, which occurs with minimal distortion, as well as the high bandwidth operation present an added advantage over conventional deflection structures. In the preferred embodiment, the deflection structures are of the travelling wave type.

The vertical and horizontal deflection structures are shielded, thus eliminating undesirable intrastructural coupling, while maintaining constant impedance.

BRIEF DESCRIPTION OF THE DRAWINGS

The above and other features of the present invention and the manner of attaining them, will become apparent, and the invention itself will be best understood, by reference to the following description and the accompanying drawings, wherein.

DESCRIPTION OF THE PREFERRED EMBODIMENT

Figure 1:
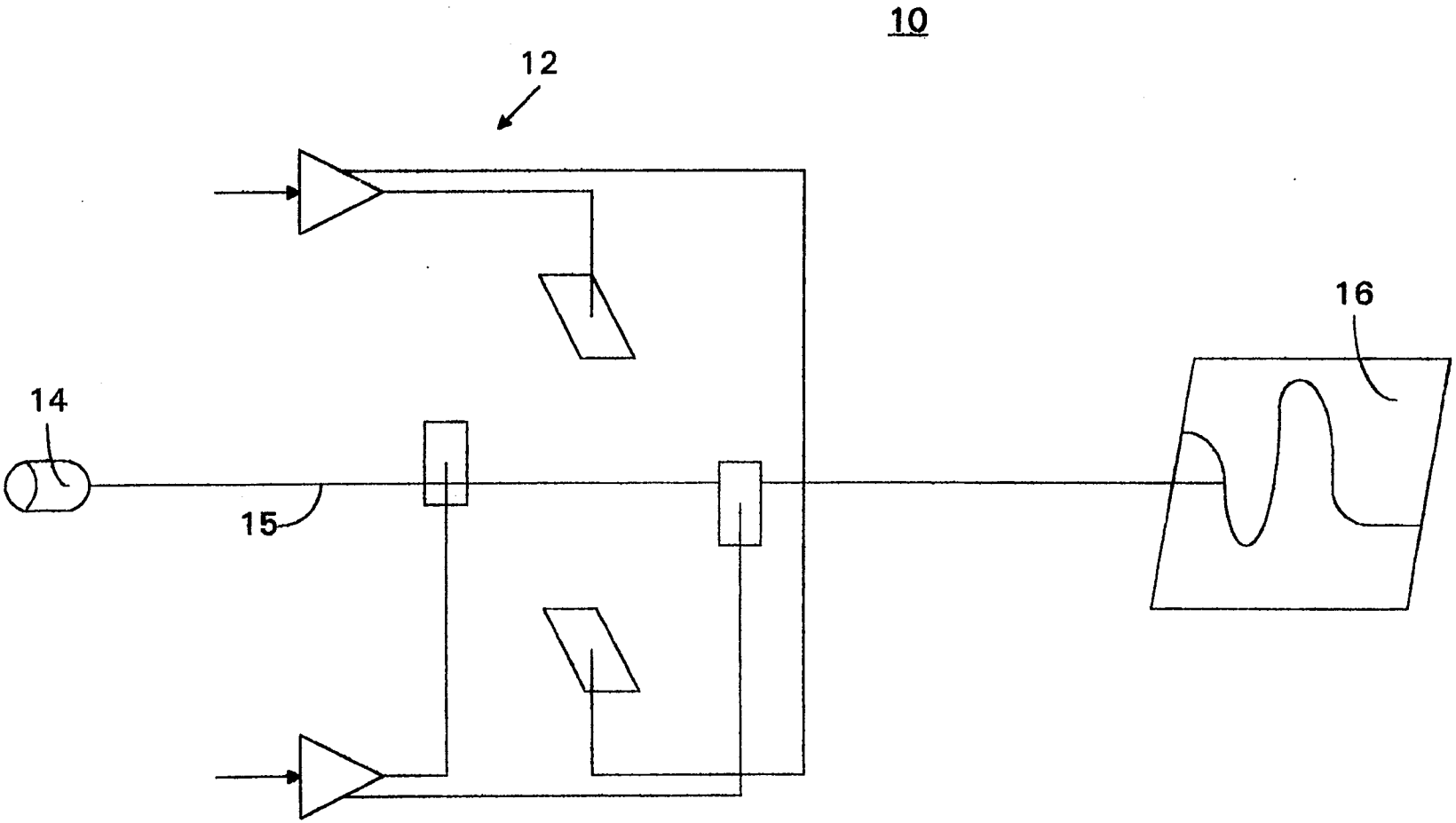
FIG. 1 is a schematic view of a cathode ray tube using a deflection structure, which is constructed according to the present invention.

Referring now to the drawings, and more particularly to FIG. 1 thereof, there is shown a cathode ray tube 10, which is schematically illustrated. The cathode ray tube 10 includes an electron source or gun 14 which generates a beam of charged particles, such as an electron beam 15, that passes through a deflection structures 12, in order to reach a target, such as a phosphor screen 16.

Figure 2:
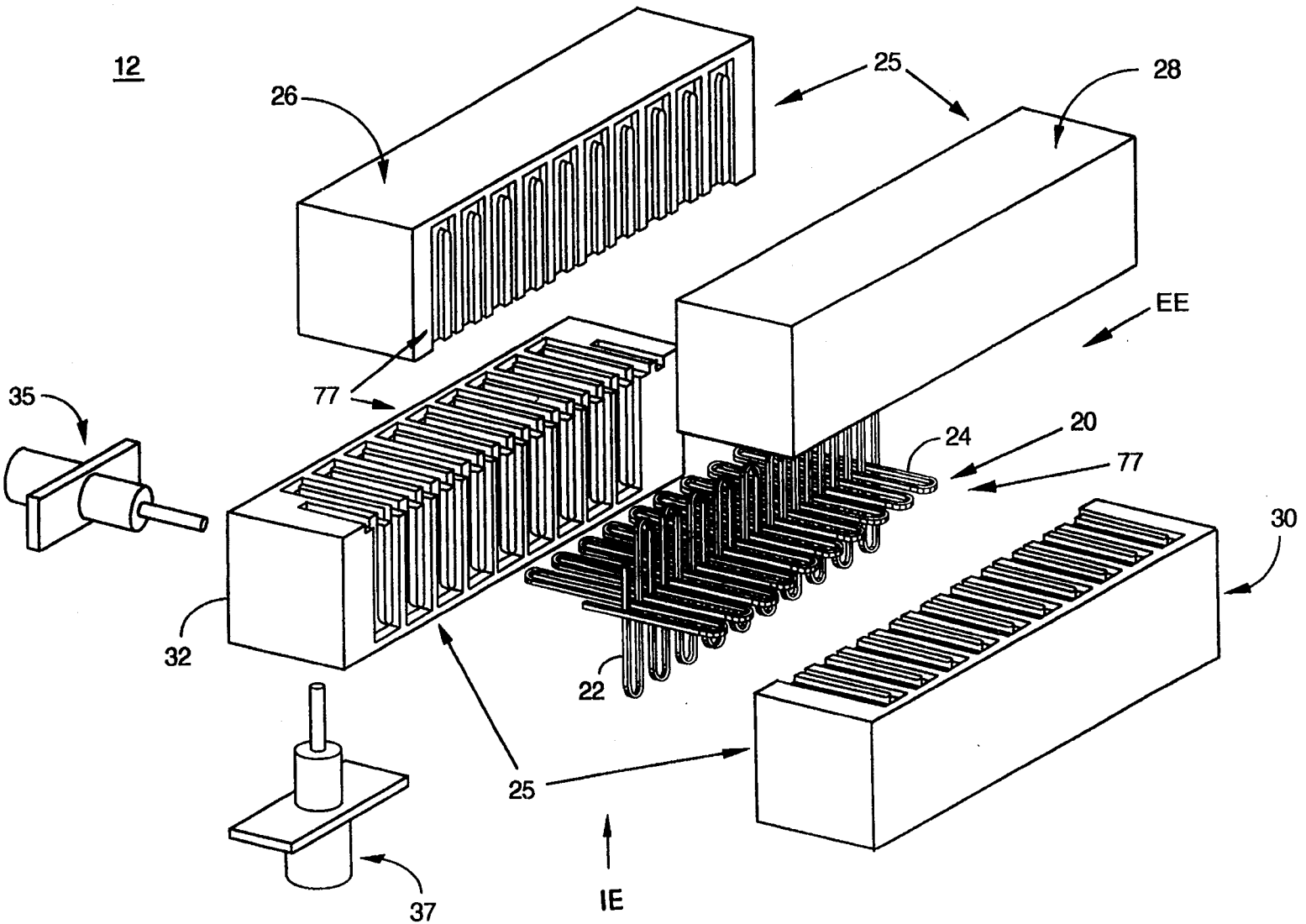
FIG. 2 is an isometric exploded view of an exemplary single ended or unbalanced deflection structure for use with the cathode ray tube of FIG. 1, illustrating a serpentine set having two interdigitated deflection elements.

The deflection structure 12 is further illustrated in a simplified, exploded isometric view in FIG. 2, and functions as a signal deflection element of improved properties. For simplicity of illustration, FIG. 2 shows a single-ended, unbalanced structure.

In the best presently known embodiment of the present invention, the shielded serpentine deflection structure 12 includes a serpentine set 20 which is housed within a shielding frame 25. The deflection structure further includes a plurality of feedthrough connectors, such as the connectors 35 and 37, for supporting the serpentine set 20. In the best embodiment, the serpentine set 20 is supported only by the feedthrough connectors.

According to the preferred embodiment of the present invention, the serpentine set 20 includes a pair of deflection elements, such as a vertical serpentine deflection element 22 and a horizontal serpentine deflection element 24, which are "interdigitated", in a balanced configuration, with respect to each other, such that the defection structure 12 is "collocated". The present deflection structure 12 results in a near zero drift space signal distortion in the cathode ray tube 10, and allows for a horizontal/vertical deflection interchangeability with minimal distortion.

Figure 3:
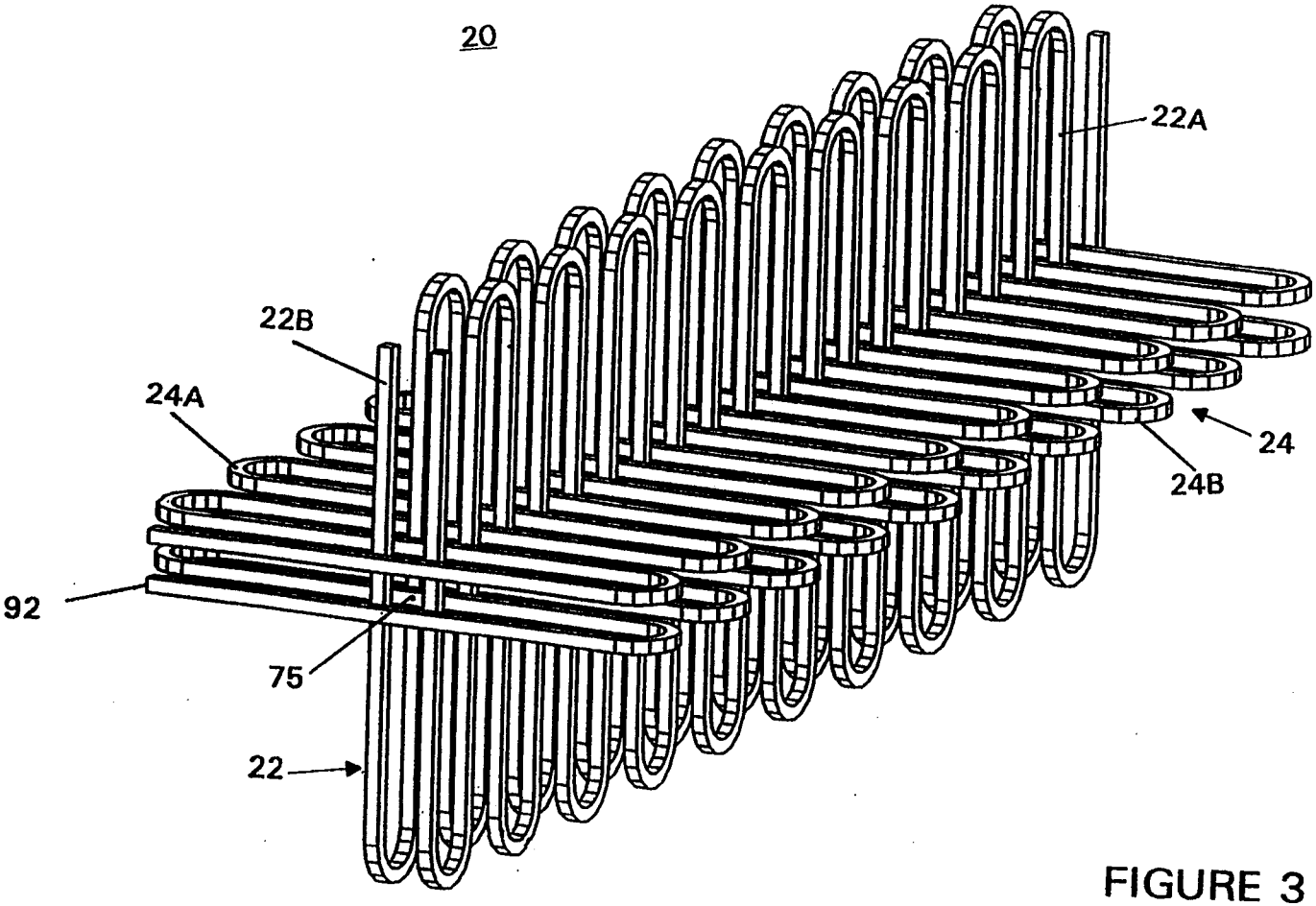
FIG. 3 is an enlarged isometric view of a serpentine set, which forms a part of the deflection structure of FIG. 2.

The use of the term "interdigitated" herein, is intended to depict the interwoven arrangement of the vertical and horizontal serpentine deflection elements 22 and 24, of serpentine set 20 as generally illustrated in FIG. 3.

The term "collocated" refers to an arrangement whereby the vertical and horizontal serpentine deflection elements 22 and 24 are not physically located in separate locations, but are rather arranged in the same location.

The electron drift space that is inherent between the conventional separate and discrete vertical and horizontal deflection elements, causes undesirable velocity modulation distortion. The present arrangement of interdigitated deflection elements 22 and 24 enables the vertical and horizontal electron beam deflection to be combined in a single deflection structure 12, such that electron intra-structure drift space is minimized, if not completely eliminated. As a result, the defocussing distortion is also significantly minimized, and in certain applications, completely eliminated.

Additionally, the collocation of the deflection structure 12 significantly reduces the longitudinal space conventionally occupied by discrete x, y deflection structures, which translates into a more compact cathode ray tube. Such collocation arrangement, along with the interdigitization of the deflection elements or deflection elements 22 and 24, enable the signals to be input either to the vertical or the horizontal deflection elements 22 or 24 respectively, thus providing a significant operational flexibility not available in conventional cathode ray tubes.

Considering now the deflection structure 12 in greater detail, with respect to FIG. 2, it generally includes the serpentine set 20, which is housed within the shielding frame 25, and a plurality of feedthrough connectors 35 and 37. In turn, the serpentine set 20 includes two generally similar, interdigitated, orthogonally arranged deflection elements: the vertical serpentine deflection element 22 and the horizontal serpentine deflection element 24.

While only two deflection elements 22 and 24 are illustrated, it should be understood to those skilled in the art, after reviewing the present disclosure, that a different number of deflection elements could be used, without departing from the teaching of the invention.

While in the preferred embodiment, the deflection elements 22 and 24 are described as being orthogonally arranged relative to each other, it should be understood that such deflection elements could be angularly, and not exactly, orthogonally arranged.

Additionally, while the preferred design of the serpentine set 20 includes two similar deflection elements 22 and 24, it should be understood that various applications for the cathode ray tube could require variations in the designs of the deflection elements 22 and 24. One exemplary alternative embodiment will be described later, in relation to FIG. 10.

It is well known in the art to deflect electron beams by means of a single slow wave deflection device, in a balanced mode or an unbalanced mode. While the present invention will be described in a balanced mode operation, it should be understood that those skilled in the art can adapt the present invention for an unbalanced mode of operation, in like manner as is done with conventional slow wave devices in such applications.

Returning to the preferred embodiment of the present invention, the deflection elements 22 and 24 have a similar design and composition, and only one deflection element, i.e., the vertical serpentine deflection element 22, will now be described in greater details.

Figure 4:
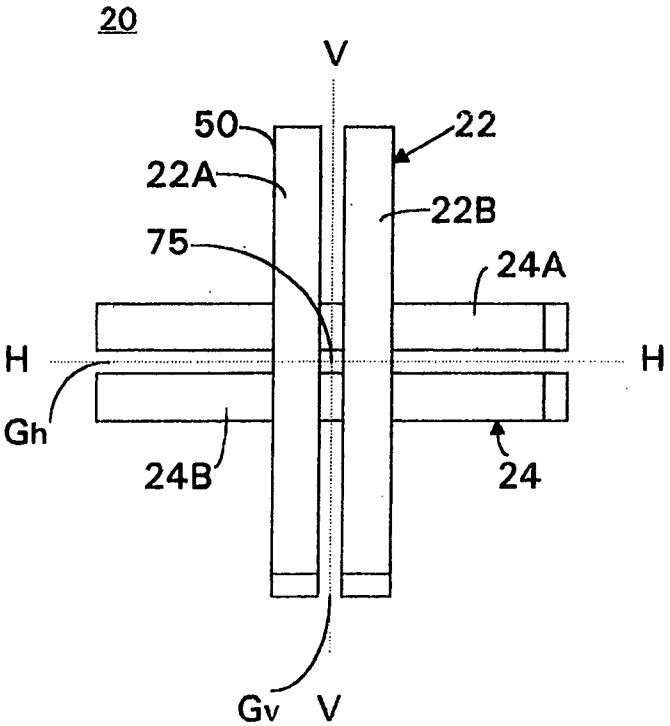
FIG. 4 is side view of the serpentine set of FIG. 3.
Figure 7:
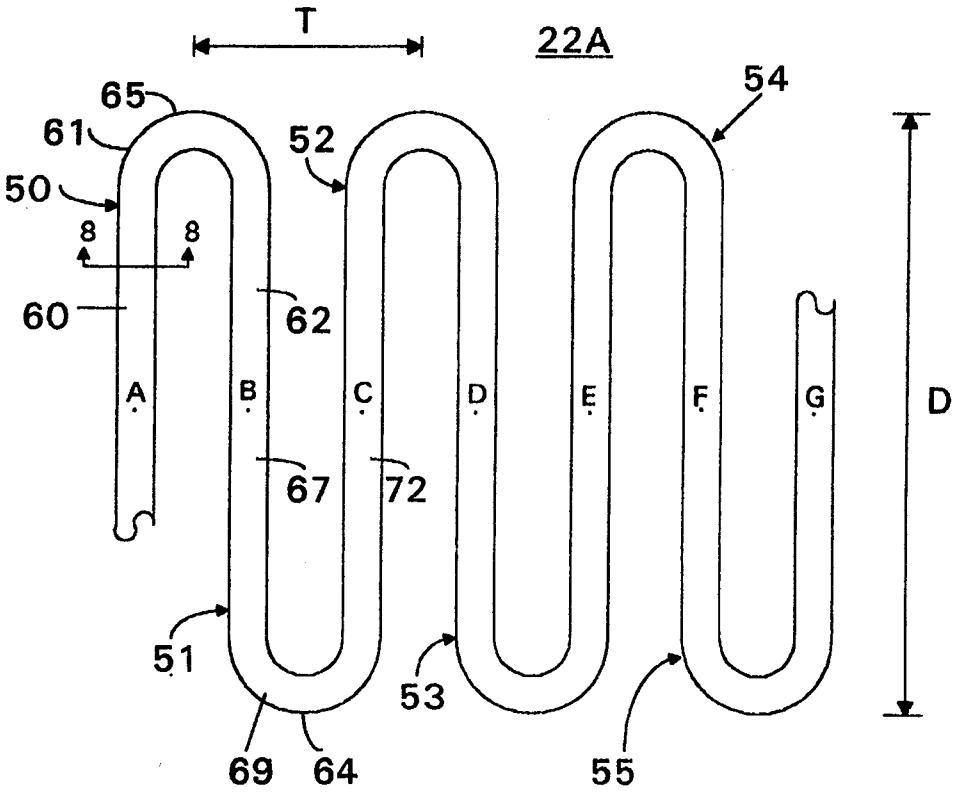
FIG. 7 is a fragmentary side plan elevational view of a serpentine conductor, forming part of the serpentine set of FIG. 3.

As illustrated in FIGS. 3, 4 and 7, the vertical serpentine deflection element 22, of the serpentine set 20, generally includes a pair of identical serpentine conductors 22A and 22B, which are equidistally spaced apart, and which are disposed in registration with each other, symmetrically relative to a hypothetical vertical plane of symmetry V—V (FIG. 4). The vertical serpentine conductors 22A and 22B form a gap Gv (FIG. 4) therebetween.

Similarly, the horizontal serpentine deflection element 24 (FIGS. 3 and 4) generally includes a pair of identical serpentine conductors 24A and 24B, which are equidistally spaced apart, and which are disposed in registration with each other, symmetrically relative to a hypothetical horizontal plane of symmetry H—H (FIG. 4). The horizontal serpentine conductors 24A and 24B form a gap Gh (FIG. 4) therebetween.

The dimensions of the gaps Gv and Gh are a function of the width of the serpentine conductors 22A, 22B, 24A and 24B, so as to maintain a uniform impedance throughout these elements. A preferable impedance value to be maintained is 50 Ohms.

Figure 9:
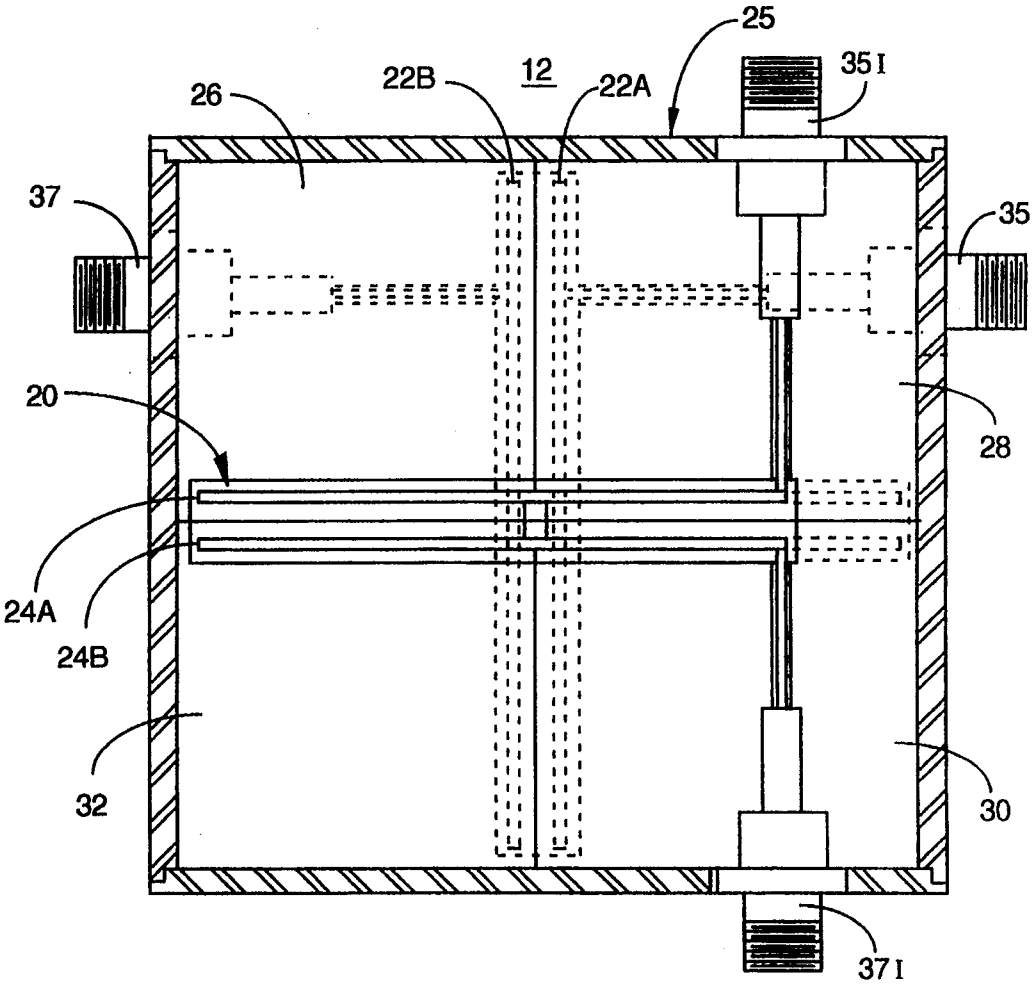
FIG. 9 is a cross-sectional end view of an exemplary assembled double-ended or balanced deflection structure.

When the vertical serpentine deflection element 22 and the horizontal serpentine deflection element 24 are interdigitated, as illustrated in FIGS. 3, 4 and 9, a central transmission passage 75 is formed by the intersection of the gaps Gv and Gh. The passage 75 extends substantially uniformly along the entire axial length of the serpentine set 20. The height and width of the passage 75 vary with the thicknesses of the gaps Gv and Gh.

As radio frequency (rf) fields travel through the deflection elements 22 and 24, the electron beam travels through the central transmission passage 75, to be deflected by the travelling rf fields. Generally, the horizontal deflection element 22 deflects the electron beam vertically, and the vertical deflection element 24 deflects the electron beam horizontally.

While in the preferred embodiment the central transmission passage 75 is uniform throughout its axial length, it should become clear that different applications could require non-uniformity of the passage 75. For instance, the passage 75 could be tapered at one end.

Figure 10:
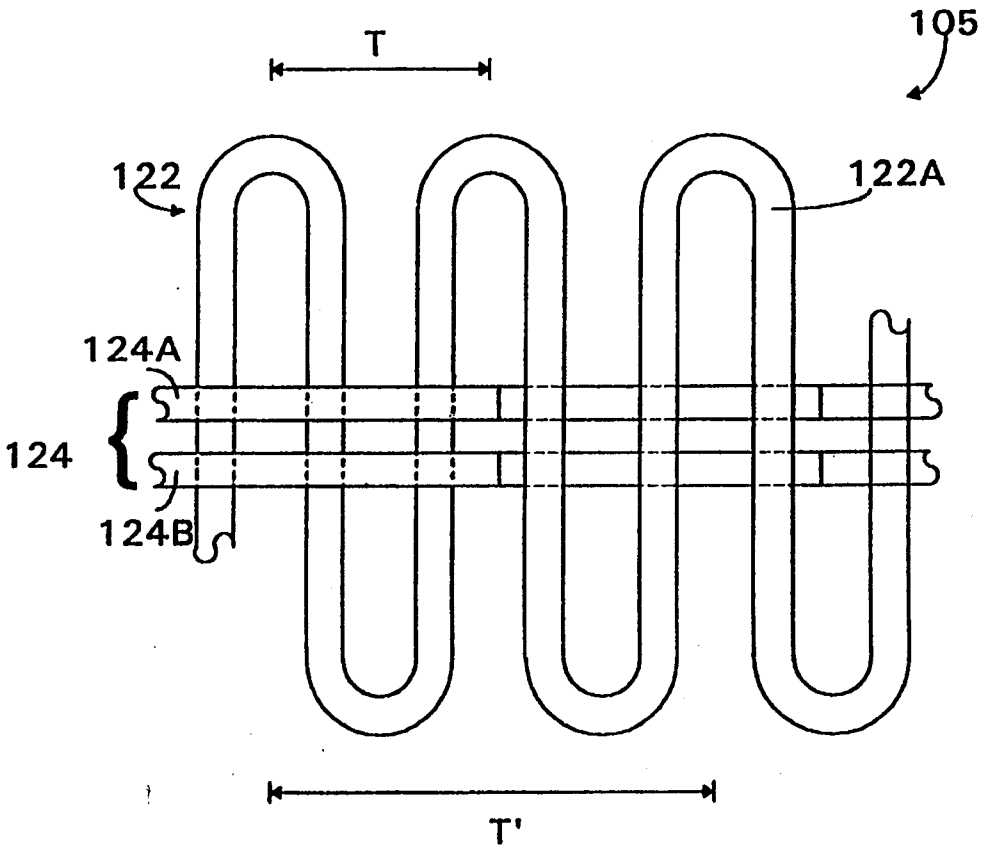
FIG. 10 is a fragmentary side plan elevational view of an alternative embodiment for a serpentine set, according to the present invention.

In the preferred embodiment of the present invention, the vertical and horizontal pairs of serpentine conductors 22A, 22B, 24A and 24B (FIG. 3 and 4) are identical, so as to allow for a higher flexibility in the interchangeability of the vertical and horizontal serpentine deflection elements 22 and 24. This feature will further facilitate the manufacture and assembly of the serpentine set 20 and the cathode ray tube 10, and will result in cost reduction. It should however be understood, as illustrated in FIG. 10, that the vertical serpentine conductors 124A and 124B (equivalent to 24A and 24B in FIGS. 3 and 4) 22A and 22B could be different from the horizontal serpentine conductors 24A and 24B.

Therefore, for brevity purpose, only the vertical serpentine conductor 22A will hereinafter be described in greater detail, in relation to FIG. 7. The vertical serpentine conductor 22A generally includes a plurality of similar, adjacent, generally co-planarly, cyclically arranged, serpentine "loops" 50, 51, 52, 53, 54 and 55. While only six loops 50–55 are illustrated, it should be understood that a different number of loops could be selected, as required by the application of the cathode ray tube 10.

The use of the term "loop" is intended to depict the portion of the serpentine conductor 22A that extends between one half the period T of the serpentine conductor 22A. For illustration purposes, the period T, which includes two loops, typically extends between two hypothetical points A and C along the central axis with the combined height of any two consecutive loops being shown here as D. It should be understood that the loop 50, which extends between the hypothetical points A and B, could alternatively, be differently shaped than the illustration in FIG. 7.

The loops 50–55 are similar in construction, and consequently, only the loops 50 and 51 will be described in greater detail. The loop 50 starts at point A and includes a longitudinal elongated leg 60 which extends into an arcuate section 61, and therefrom into another longitudinal elongated leg 62. The loop 50 terminates at point B. The legs 60 and 62 are generally identical, and are spaced apart by about one half a period (T/2). The arcuate section 61 includes a peak point 65.

Similarly, the loop 51 starts at point B and extends into a longitudinal elongated leg 67, an arcuate section 69, and a longitudinal elongated leg 72. The loop 51 terminates at point C. The legs 67 and 72 are generally identical to each other and to the legs 60 and 62 of the loop 50. The arcuate section 69 includes a peak point 64. Loops 67 and 72 are also spaced apart by one half a period (T/2). The leg 62 of the loop 50 and the leg 67 of the loop 51 are co-linearly aligned, and practically form a single unitary structure. Similarly, loop 52 begins at point C and terminates at point D; loop 53 begins at point D and terminates at point E; loop 54 begins at point E and terminates at E; loop 54 begins at point E and terminates at point F; and loop 55 begins at point F and terminates at point G.

Figure 8:
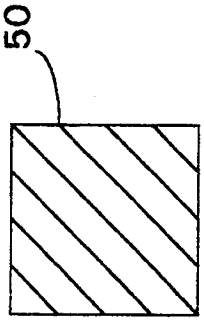
FIG. 8 is a greatly enlarged cross-sectional view of the vertical serpentine conductor of FIG. 7, taken along line 8—8 thereof.

The serpentine conductor 22A is formed to the desired shape by an electro-discharge machine (EDM), or such other appropriate tooling. The serpentine conductor 22A has a substantially uniform cross section along its entire length. FIG. 8 shows an exemplary cross section of the loop 50 along the line 8—8 of FIG. 7.

In the preferred embodiment, the loop 50 has a square cross section. It should be understood that the loop 50 could alternatively have a different cross sectional shape, i.e., rectangular, circular, etc. It has been experimentally found that for a 4 KV accelerating voltage for the electron beam, and a target structure bandwidth of about 10 GHz, an optimal result is achieved when each loop, i.e. 50, of the deflection structure 12, has a square cross section of 25 mils×25 mils (i.e. 25 thousandth of an inch), and the serpentine trough 77 has a cross section of 62 mils×62 mils.

The serpentine conductor 22A is preferably made of high conductivity non-magnetic material suitable for high vacuum applications such as molybdenum, or such similar electrically conductive material.

Turning now to the shielding frame 25, it will be described in greater detail with respect to FIGS. 2 and 9. The frame 25 generally includes four substantially identical ground blocks 26, 28, 30 and 32, which house corresponding sections of the serpentine set 20, for shielding the adjacent loops of the serpentine elements.

As illustrated in FIG. 9, when the deflection structure 12 is assembled, the serpentine set 20 is completely enclosed within the shielding frame 25. The shielding frame 25 then becomes an integral elongated block with a generally though not necessarily rectangular cross section.

Referring again to FIG. 2, the shielding block 25 includes a serpentine trough 77 which is machined therethrough, along substantially its entire axial length, in order to accommodate the serpentine set 20. The serpentine trough 77 serves to shield the adjacent loops, such as the loops 50 and 52 (see FIG. 7) from each other, as well as from the remaining loops. It should be understood that different shapes, dimensions and composition could be used for the shielding block 25.

In the preferred embodiment, two opposite ground blocks, such as (26, 30) and (28, 32) are generally similar in design and composition, such that each block houses one quadrant of the serpentine set 20. For example, and as illustrated in FIG. 9, the block 26 coincides with, and houses the upper half of the serpentine conductor 22A as well as one half of the orthogonally disposed serpentine conductor 24A. Similarly, the block 32 coincides with, and houses the lower half of the serpentine conductor 22A as well as one half of the orthogonally disposed serpentine conductor 24B.

This modular type construction of the shielding block 25 facilitates the manufacture of the ground blocks 26, 28, 30 and 32, and reduces the assembly time and cost of the deflection structure 12. This may reduce the overall production cost of the cathode ray tube 10. The serpentine set 20 fits within the vacuum filled serpentine trough 77, without physically touching the ground blocks.

The shielding frame 25 is preferably made of highly conductive, non magnetic material, such as oxygen free copper, silver or gold.

In operation, the deflection field travels along the serpentine set 20, in time synchronization with the electron beam travelling along the central transmission passage 75. Thus, spurious deflection signals that are out of time synchronization with the electron beam 15, are not generated by the coupling between adjacent loops.

Referring again to FIG. 9, the feedthrough connectors 35 and 37 are, in rf models, mounted in the ground blocks 26, 28, 30 and 32. There is no additional support structure. In CRT applications, the entire deflection structure 12 is contained within a vacuum tight envelope constructed of non-magnetic, weldable metallic material such as 304 stainless steel. The connector feedthroughs now form a vacuum penetration by being vacuum tight welded into the vacuum envelope.

The deflection structure ground blocks with the connector feedthroughs and serpentine conductors are preassembled before insertion into the vacuum envelope. This serves to accurately locate the connector feedthroughs (and the entire deflection structure) with respect to the vacuum envelope and the centerline (the beamline) of the CRT.

In the preferred embodiment, the vacuum envelope will be made in longitudinal sections facillitating the enclosure of the deflection structure and the seams (and feedthroughs) vacuum tight welded.

While only two feedthrough connectors 35 and 37 are shown in FIG. 2, it should be understood that additional feedthrough connectors could also be used. In the preferred embodiment, eight identical feedthrough connectors are used. Four feedthrough connectors 35, 37, 35I and 37I are shown in FIG. 9.

As illustrated in FIG. 2, the serpentine set 20 has an input end IE, and an output end EE. One feedthrough connector (i.e. 35, 37, 35I, 37I as shown in FIG. 9) is connected to the input end of each of one of the serpentine elements 22A, 22B, 24A and 24B (FIG. 9). Similarly, while not illustrated, one feedthrough connector is connected to the output end of each one of the serpentine conductors 22A, 22B, 24A and 24B.

Figure 5:
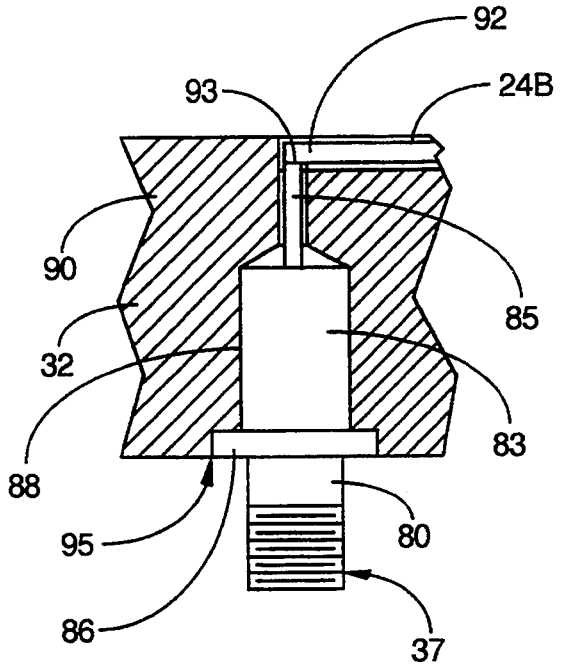
FIG. 5 is a greatly enlarged, partly sectional view, illustrating the interconnection between a serpentine conductor, a ground block and a feedthrough connector, of FIGS. 2 through 4, according to the teaching of the present invention.

Considering now one exemplary feedthrough connector 37 in greater detail, in relation to FIG. 5, it is generally of the coaxial type, and includes an outer conductor 80, an insulator 83, an inner conductor 85, and a base 86. The inner conductor 85 and the insulator 83 are mounted within a matching connection port 88 at the proximal end 90 of the ground block 32. The outer conductor 80 protrudes outside the ground block 32, and is connected to a ground (or low) potential.

The inner conductor 85 supports, and is electrically connected to one end 92 of the serpentine conductor 24B (see FIG. 3), by means of conventional methods, such as by welding at point 93. The feedthrough connector 37 is similarly affixed to the ground block 32 by means of conventional means, such as by welding or mechanical fastening at point 95.

The diameter of the inner conductor 85 is selected to be about the same as the side dimension (i.e. 25 mils in the above example) of the inner conductor of the serpentine element.

Figure 6:
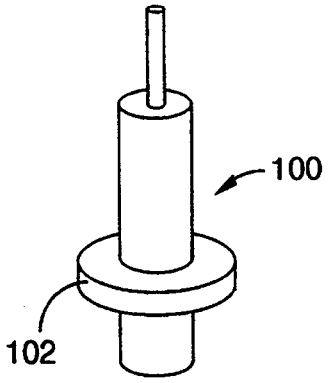
FIG. 6 is a partial isometric view of a modified feedthrough connector.

FIG. 6 illustrates another embodiment of a feedthrough connector 100. The feedthrough connector 100 is similar in construction, design and composition to the feedthrough connector 37, with the exception that the feedthrough connector 100 includes a circular base 102, while the feedthrough connector 37 includes a rectangular base 86. Other shapes for the feedthrough connectors are also contemplated within the scope of the present invention.

In the preferred embodiment, the cathode ray tube operates in a balanced mode, where the vertical serpentine deflection element 22 and the horizontal serpentine deflection element 24 are identical in construction and design. A uniform field is then created within the central transmission path (also referred to as the electron beam interaction space) 75, while maintaining a constant impedance within such central transmission path 75.

The constant impedance within the central transmission path 75 is maintained because of the "virtual ground" of the balanced system, where the signals in two halves of the system are opposite and equal. A thin ground plane shield (not shown) could be inserted between each quadrant to minimize the coupling between the serpentine conductors 22A, 22B, 24A and 24B.

In order to preserve a uniform and continuous impedance along the entire length of the serpentine conductors 22A, 22B, 24A and 24B, the change of impedance at the arcuate sections, such as the arcuate sections 61 and 69 (FIG. 7), is compensated by a corresponding change in the cross-sections of either the serpentine conductors 22A, 22B, 24A, 24B, or the serpentine trough 77 (see FIG. 2). The type and amount of change is determined by the extent of impedance difference, and whether such impedance is caused by inductive or capacitive deviations.

The alignment of the serpentine set 20 within the serpentine trough 77 is very important. Such alignment could be accomplished by conventional "jigging" methods. By jigging it is understood the precise positioning of the serpentine set 20 within, and in relation to the trough 77. One particular method is vacuum jigging, which allows the serpentine set 20 to be positioned within the trough 77, while it is being connected to the feedthrough connectors.

In order to position the ground blocks 26, 28, 30 and 32 of the frame 25, relative to each other, a plurality of locating pins (not shown) fit in corresponding pins holes (not shown) in the ground blocks. Other conventional alignment methods could alternatively be used to align the deflection structure 12 and the frame 25.

FIG. 9 is a cross sectional view of the assembled best presently known embodiment of the present invention, and depicts two orthogonal sets of serpentines and shielding troughs. This configuration is referred to as a balanced or double-ended structure.

It can be seen that the serpentine set 20 is distally disposed from, and does not directly touch any outer structure, such as a ground plane (not shown). The serpentine set 20 is solely supported by means of the feedthrough connectors, such as the connectors 35 and 37, in order to significantly minimize or entirely eliminate capacitive or inductive coupling to the ground plane or similar other structures, thus creating an impedance discontinuity.

FIG. 10 is a fragmentary side plan elevational view of an alternative embodiment of a serpentine set 105. The serpentine set 105 includes a vertical serpentine deflection element 122, and a horizontal serpentine deflection element 124. The vertical serpentine deflection element 122 is similar in design and construction to the vertical serpentine deflection element 22, such that the period of the serpentine conductor 122A is equal to that of the serpentine conductor 22A, namely T.

However, the horizontal serpentine deflection conductor 124, in this exemplary embodiment, includes two periodic horizontal serpentine conductors 124A and 124B. The period T′ of these serpentine conductors 124A and 124B is equal to "2T", that is twice that of the vertical serpentine conductor 122A. In other embodiments, the values of the periods T and T′ could be selected to suit particular applications.

While specific embodiments of the deflection structure have been illustrated and described, in accordance with the present invention, modifications and changes of the apparatus, parameters, materials, methods of manufacture, etc. will become apparent to those skilled in the art, without departing from the scope of the invention.

What is claimed is:

1. A deflection structure to deflect a beam of charged particles comprising:

a first deflection element defining a first serpentine transmission line including a first pair of identical, equidistantly spaced-apart serpentine conductors that are disposed in registration with each serpentine conductor of said first pair having a selected axial length, and which are arranged to define a first gap therebetween; and a second deflection element defining a second serpentine transmission line;

said first and second deflection elements being angularly disposed relative to each other and interdigitated to produce a transmission passage including said first gap through which said charged particle beam is to pass.

2. The deflection structure according to claim 1 wherein said first and second serpentine transmission lines are orthogonally disposed relative to each other.

3. The deflection structure according to claim 1 wherein:

said first serpentine transmission line is vertically disposed; and said second serpentine transmission line is horizontally disposed.

4. The deflection structure according to claim 3 wherein said first and second serpentine transmission lines are collocated and each is in a balanced arrangement.

5. The deflection structure according to claim 1 further includes a shielding frame substantially surrounding said first and second deflection elements and defining therewithin internal serpentine passages to receive sections of said first and second serpentine transmission lines to shield adjacent sections thereof from each other while leaving said transmission passage unobstructed.

6. The deflection structure according to claim 5 wherein:

each of said first and second serpentine transmission lines includes a respective plurality of adjacent loops; and said shielding frame shields adjacently disposed loops of each of said first and second serpentine transmission lines from each other.

7. The deflection structure according to claim 6 wherein:

said first and second serpentine transmission lines are substantially perpendicular one to the other; and said shielding frame includes four substantially identical mating ground blocks.

8. The deflection structure according to claim 5 further includes a plurality of feedthrough connectors extending through said shielding frame and electrically connected to said first and second serpentine transmission lines.

9. The deflection structure according to claim 1 wherein said second serpentine transmission line includes a second pair of identical, equidistantly spaced-apart serpentine conductors that are disposed in registration with each other, each serpentine conductor of the second pair having an axial length which is the same as said selected first length of said first pair of serpentine conductors, and which define a second gap therebetween, with said second gap also included in said transmission passage.

10. The deflection structure according to claim 9 wherein said first pair of identical serpentine conductors has a periodic configuration, with a first period.

11. The deflection structure according to claim 10, wherein said second pair of identical serpentine conductors has a periodic configuration, with a second period.

12. The deflection structure according to claim 11, wherein said first and second periods are different.

13. The deflection structure according to claim 11, wherein said first and second periods are equal.

14. The deflection structure according to claim 13 wherein said first pair of identical serpentine conductors and said second pair of identical serpentine conductors have identical serpentine configurations that operate in a balanced mode.

15. The deflection structure according to claim 9 further including:

a shielding frame substantially surrounding said first and second deflection elements and defining therewithin internal serpentine passages to receive sections of said first and second serpentine transmission lines to shield adjacent sections thereof from each other while leaving said transmission passage unobstructed; and eight feedthrough connectors extending through said shielding frame; and wherein:

each serpentine conductor of each of said first and second pairs of serpentine conductors, respectively, has an input end and an output end;

four of said eight feedthrough connectors are individually electrically connected to said input end of each of said serpentine conductors; and the remaining four of said eight feedthrough connectors are individually electrically connected to said output end of each of said serpentine conductors.

16. The deflection structure according to claim 15 wherein each of said feedthrough connectors are electrically and mechanically identical one to the other.

17. The deflection structure according to claim 16 wherein said eight feedthrough connectors maintain alignment of said serpentine conductors within said shielding frame.

18. The deflection structure according to claim 9 wherein said first gap and said second gap intersect to centrally locate said transmission passage with said charged particle beam passing through both of said first and second gaps.

19. The deflection structure according to claim 18 wherein said centrally located transmission passage extends substantially uniformly along the entire axial length of said first and second pair of serpentine conductors.

* * * * *